US006749461B2

(12) United States Patent
Ishikawa et al.

(10) Patent No.: US 6,749,461 B2
(45) Date of Patent: Jun. 15, 2004

(54) CONNECTOR

(75) Inventors: Ryotaro Ishikawa, Yokkaichi (JP); Hajime Kawase, Yokkaichi (JP); Hideto Nakamura, Yokkaichi (JP); Takeshi Tsuji, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/370,188

(22) Filed: Feb. 19, 2003

(65) Prior Publication Data

US 2003/0157835 A1 Aug. 21, 2003

(30) Foreign Application Priority Data

Feb. 19, 2002 (JP) ..... 2002-041413

(51) Int. Cl.[7] ..... H01R 13/422
(52) U.S. Cl. ..... 439/595
(58) Field of Search ..... 439/595, 752

(56) References Cited

U.S. PATENT DOCUMENTS 5,299,958 A 4/1994 Ohsumi
5,842,884 A * 12/1998 Maegawa et al. ..... 439/595
5,928,034 A * 7/1999 Tabata et al. ..... 439/595
6,123,574 A * 9/2000 Matsuda et al. ..... 439/595
6,186,813 B1 * 2/2001 Tomita et al. ..... 439/595
6,332,803 B1 * 12/2001 Matsuda et al. ..... 439/595
6,547,594 B2 * 4/2003 Ichio et al. ..... 439/595

* cited by examiner

*Primary Examiner*—Gary Paumen
(74) *Attorney, Agent, or Firm*—Anthony J. Casella; Gerald E. Hespos

(57) ABSTRACT

A connector has a housing (20) with cavities (25) for receiving terminal fittings (10). A resiliently deformable lock (30) extends along a wall (25A) of each cavity (25) and is configured for locking the terminal fitting in the cavity (25). An elongated projection (31) is formed at a widthwise center position of the upper surface of each lock (30) and an escaping groove (34) is formed in the wall (25A) of each cavity (25) for receiving the elongated projection (31) when the lock (30) deforms. The elongated projection (31) reinforces the lock (30) and provides a large engaging area with the terminal fitting (10). Additionally, the escaping groove (34) provides a necessary a deformation permitting space (35) for the thicker lock (30) without increasing the height of the housing (20).

12 Claims, 10 Drawing Sheets

CONNECTOR

BACKGROUND OF THE INVENTION

1. Field of the Invention

The invention relates to a connector in which terminal fittings are locked in cavities by resin locks.

2. Description of the Related Art

U.S. Pat. No. 5,299,958 and FIG. 10 herein show connectors with resiliently deformable locks. With reference to FIG. 10, the connector has a housing 1 and terminal fittings 2 are inserted into cavities 3 formed in the housing 1. Each cavity 3 has a resiliently deformable lock 4 cantilevered along an insertion direction of the terminal fitting 2. The lock 4 is pushed and deformed as the terminal fitting 2 is inserted into the cavity 3. However, the lock 4 returns resiliently to its original shape and fits into a locking hole 5 of the terminal fitting 2 to lock the terminal fitting 2 that has been inserted to a proper position.

The lock 4 arguably could be thicker to reinforce the locking force on the terminal fitting 2. However, this requires a larger deformation permitting space 6 to permit deformation of the thicker lock 4. A larger deformation permitting space 6 conflicts with a design need for reducing the height of the connector.

The invention was developed in view of the above, and an object thereof is to reinforce a lock without hindering miniaturization of a connector.

SUMMARY OF THE INVENTION

The invention relates to a connector with a housing that has cavities for receiving terminal fittings. A resiliently deformable lock is cantilevered along a wall of each cavity for locking the terminal fitting in the respective cavity. A projection is formed on a surface of the lock facing the wall of the cavity along which the lock extends and a recess is formed in the wall that faces the lock for receiving the projection when the lock deforms.

The projection reinforces the locking force of the lock, but also reduces the amount of resilient deformation of the lock. However, the recess in the wall of the cavity that faces the lock enables the projection to escape. Thus, a necessary dimension of the deformation permitting space between the lock and the wall of the cavity is less and the connector can be smaller.

The cavity preferably has no side walls at the opposite widthwise sides of the lock. Thus, at least one side of the lock projects from side surfaces of the terminal fitting, and the projecting ends of the lock can be pushed by a disengaging jig for deforming and disengaging the lock. The locking force is reinforced by the wider lock, and the construction of a portion to disengage the lock is simplified.

The projection preferably is at a substantially widthwise center position and is symmetrical on the lock. Thus, the lock can be deformed straight in a well-balanced manner and, as a result, the terminal fitting can be inserted smoothly.

The projection may be in an area of the lock excluding at least one widthwise side thereof, and only the one side of the lock contacts an opening edge of the recess when the lock is deformed. Thus, the lock undergoes a twisting resilient deformation. Accordingly, a degree of the resilient deformation of the entire lock is smaller while ensuring a sufficient lifted extent of the lock to a specified position necessary for permitting passage of the terminal fitting. As a result, the deformation permitting space can be made smaller and the height of the connector housing can be reduced further.

A front cap preferably is mounted to the front of the housing. The front cap preferably has a shake preventing wall to hold the terminal fitting tightly in cooperation with a wall of the cavity substantially opposite from the wall where the lock is provided. Thus, the terminal fitting is prevented from shaking.

The front cap may have a retainer to project into a deformation permitting space for the lock. The front cap is mounted after the terminal fitting is inserted into the cavity and locked by the lock. The retainer then projects into the deformation permitting space to prevent the deformation of the lock and hence locks the terminal fitting doubly.

The cavities may be provided at two or more stages, and the recess is formed in the wall to communicate with an adjacent cavity.

The projection preferably is formed so as not to project into the adjacent cavity also when the lock is deformed.

The lock preferably is substantially as wide as the cavity.

The projection preferably has a substantially trapezoidal cross section.

The projection preferably is substantially in parallel to the wall of the cavity when the lock is in an unbiased condition.

These and other features and advantages of the invention will become more apparent upon reading the following description of preferred embodiments and accompanying drawings. Even though embodiments are described separately, single features may be combined to additional embodiments.

DETAILED DESCRIPTION OF THE PREFERRED EMBODIMENTS

Hereinafter, preferred embodiments according to the present invention are described with respect to the accompanying drawings.

Figure 1:
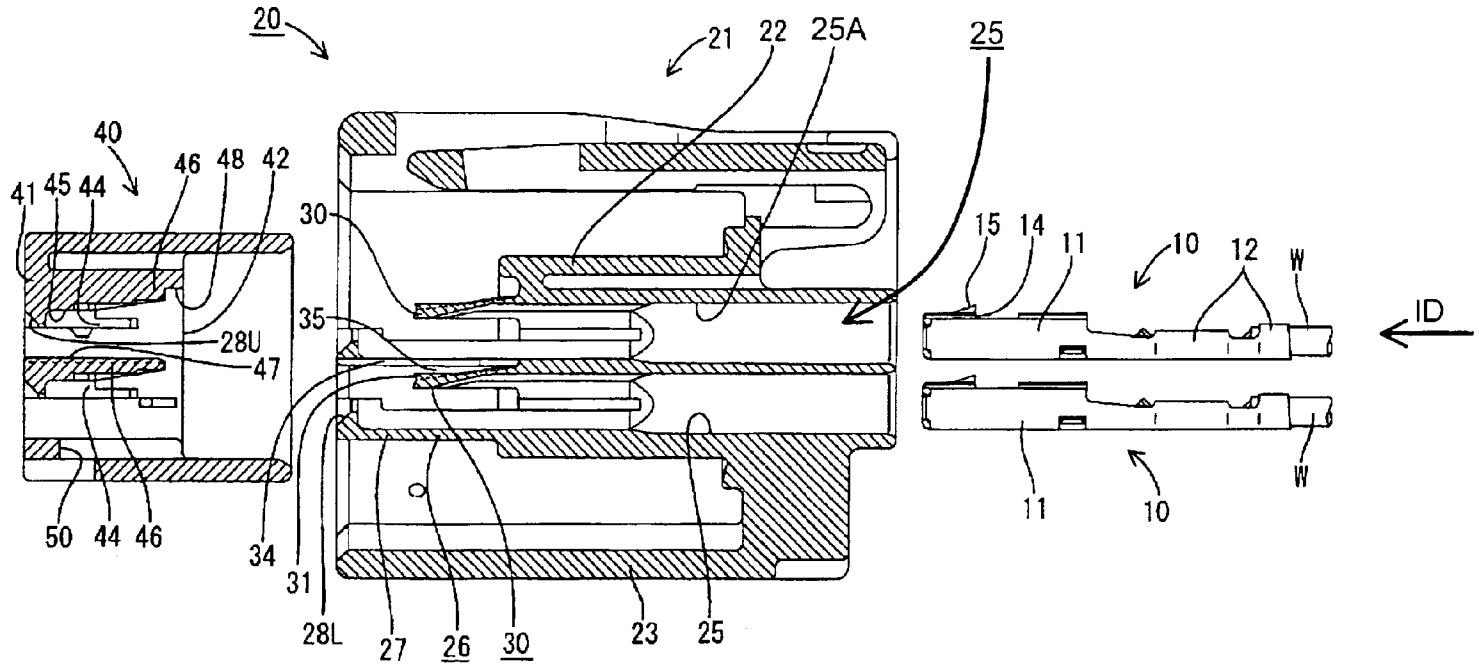
FIG. 1 is an exploded longitudinal sectional view of a connector according to a first embodiment of the present invention.

A first preferred embodiment of the present invention is described with reference to FIGS. 1 to 8. A female connector is shown in this embodiment. As shown in FIG. 1, this female connector is roughly comprised of a connector housing 20 (hereinafter, "housing") and one or more female terminal fittings 10 to be at least partly accommodated therein. The housing 20 is comprised of two pieces, i.e. a housing main body 21 and a front wall member 40.

It should be noted that left side in FIG. 1 or a mating side with a mating connector (not shown) or a side where the front wall member 40 is to be arranged is referred to as front side in the following description.

A connector according to the invention includes female terminal fittings 10, as shown in FIG. 1. Each female terminal fitting 10 is press-formed from a highly conductive metal plate to define an elongate structure with opposite front and rear ends. A substantially rectangular tubular connecting portion 11 extends rearwardly from the front end of each female terminal fitting 10 and is configured for connection with a tab of a mating male terminal fitting. Barrels 12 are disposed at the rear end of the female terminal fitting 10 and are configured for crimped connection with an end of a wire W.

A locking hole 14 having a specified length is formed over substantially the entire width in the upper surface of the connecting portion 11 and a locking section 15 projects at a widthwise center of the front edge of the locking hole 14.

Figure 2:
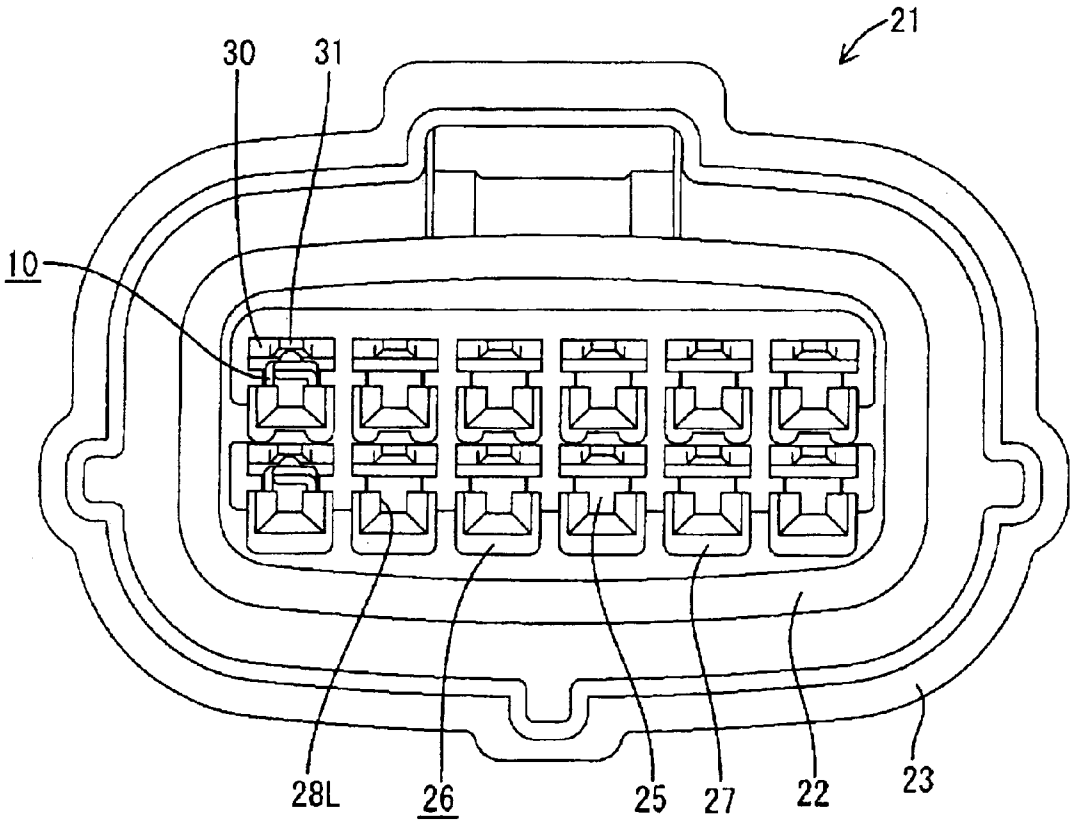
FIG. 2 is a front view of a housing main body.
Figure 3:
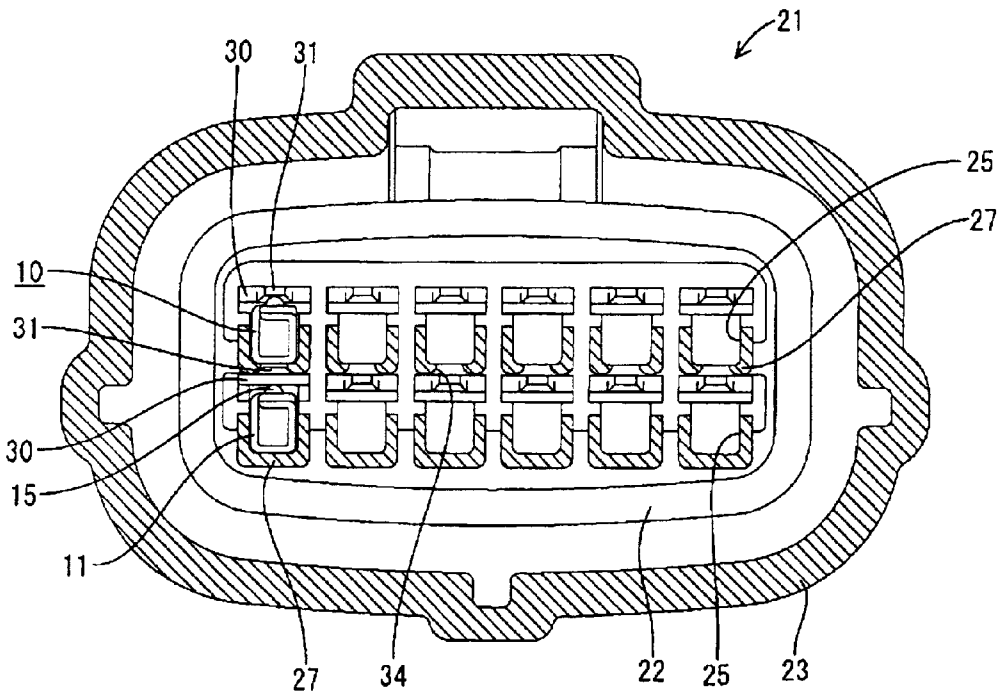
FIG. 3 is a lateral sectional view of the housing main body.

The connector also includes a housing 20 with a main body 21 formed e.g. of a synthetic resin. The main body 21 has a tower 22 and a receptacle 23 that covers at least part of the outer peripheral surface of the front side of the tower 22, as shown in FIGS. 2 and 3. Cavities 25 are arranged at upper and lower stages inside the main body 21 and extend in forward and backward directions. The female terminal fittings 10 are insertable into the corresponding cavities 25 in a rear-to-front inserting direction ID. A front end of the tower 22 is divided into separate terminal accommodating portions 26 at positions substantially corresponding to the respective cavities 25.

Each terminal accommodating portion 26 has a lower accommodating wall 27 that forms a bottom portion of the front surface and the opposite side surfaces of the cavity 25. The connecting portion 11 of each female terminal fitting 10 is accommodated in the lower accommodating wall 27 and fits closely along the widthwise direction (see FIG. 3). The front surface of the lower accommodating wall 27A includes a lower portion 28L of a terminal insertion opening 28 for receiving the tab of the mating male terminal fitting.

Each cavity 25 has a ceiling 25A. However, the ceiling 25A of the upper stage does not extend sufficiently forward to oppose the terminal accommodating portion 26. On the other hand, the lower accommodating wall 27 at the upper stage defines part of the ceiling 25A of the corresponding cavity 25 at the lower stage in the area opposed to the terminal accommodating portion 26.

Figure 4:
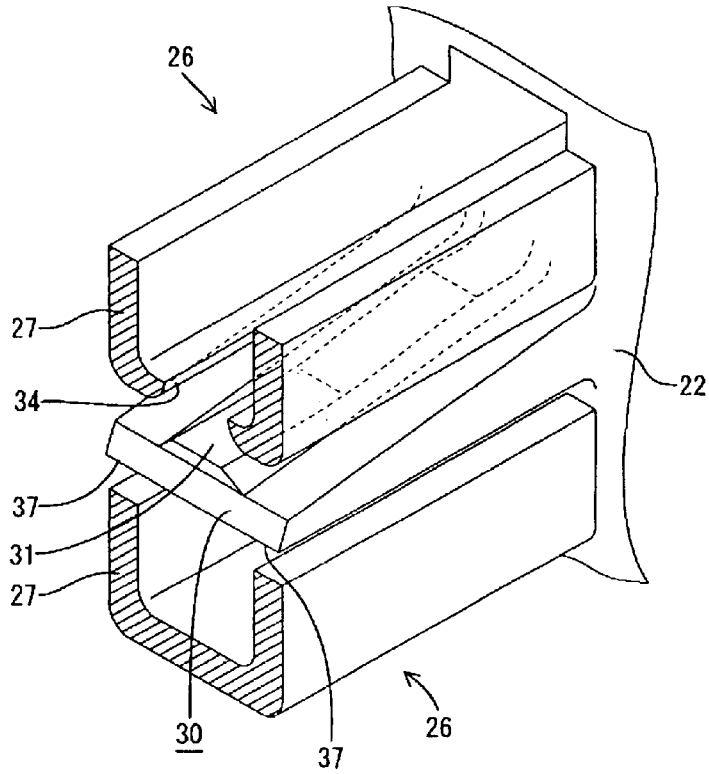
FIG. 4 is a perspective view showing a portion near a locking portion.
Figure 7:
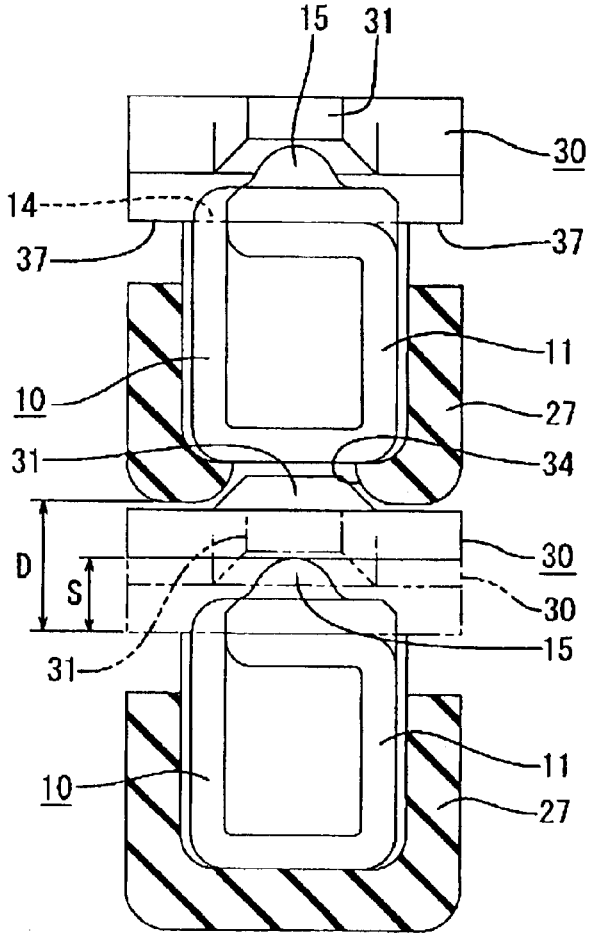
FIG. 7 is a fragmentary enlarged lateral sectional view showing a resiliently deformed state of the locking portion.
Figure 8:
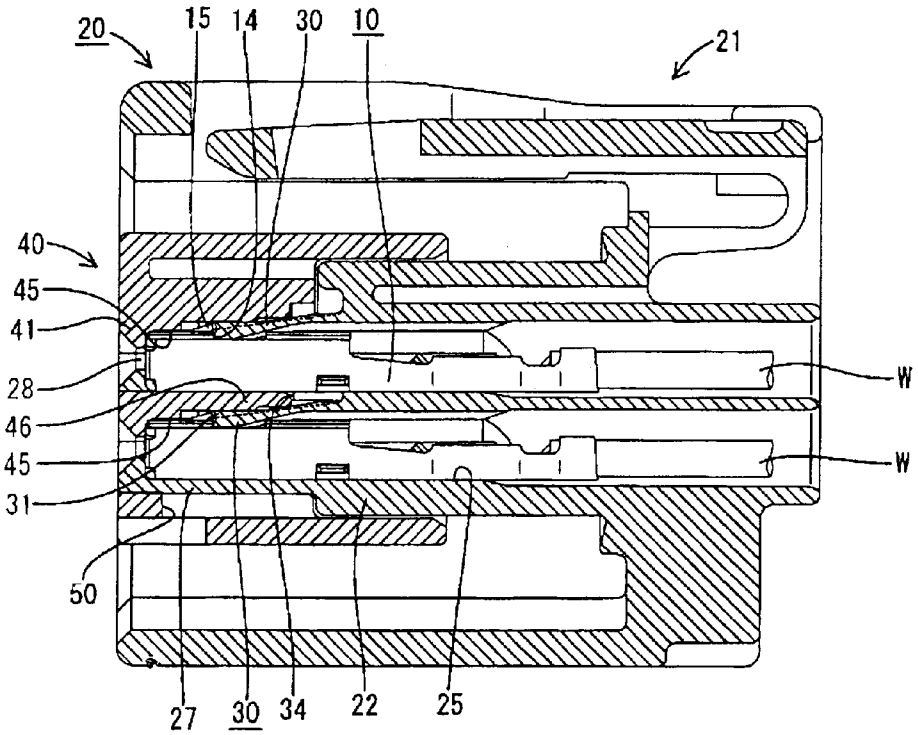
FIG. 8 is a longitudinal sectional view showing a state where the assembling of the connector is completed.

A lock 30 is cantilevered forward from the ceiling 25A of each cavity 25 and has a width substantially equal to a distance between the left and right outer side surfaces of the lower accommodating wall 27, as shown in FIGS. 4 and 7. Thus, the lock 30 is wide and the left and right sides of the lock 30 project from the left and right side surfaces of the connecting portion 11. As shown in FIG. 1, the lock 30 extends obliquely forward in the inserting direction ID and slightly down from a base end of the terminal accommodating portion 26. The leading end of the lock 30 is resiliently deformable up in a deformation direction. As shown in FIGS. 7 and 8, the leading end surface of the lock 30 is engageable with the front edge of the locking hole 14 of the female terminal fitting 10 and the bottom portion of the locking section 15.

An elongated projection 31 projects substantially at a widthwise center of the upper surface of the lock 30 and extends from the front edge of the lock 30 substantially to a longitudinal center position. The elongated projection 31 has a substantially trapezoidal cross section, as shown in FIG. 7. The upper surface of the front side of the elongated projection 31 is substantially parallel to the bottom surface of the cavity 25 when the lock 30 is in an unbiased condition and the leading end surface of the elongated projection 31 defines an overhang, as shown in FIG. 1.

A forwardly open escaping groove 34 is formed in the ceiling 25A of the lower stage cavity 25, which is the bottom of the lower accommodating wall 27 at the upper stage. The escaping groove 34 communicates with the corresponding upper stage cavity 25 and is dimensioned to receive the elongated projection 31 of the corresponding lock 30 at the lower stage.

The lock 30 at the lower stage is resiliently deformable up toward the adjacent stage so that the elongated projection 31 fits into the escaping groove 34. The opposite side edges of the lock 30 contact the side edges of the bottom surface of the escaping groove 34 to restrict the resilient deformation of the lock 30. The elongated projection 31 is set to stay in the escaping groove 34 without projecting into the cavity 25 at the upper stage at this time.

The connector also includes a front cap 40 formed e.g. of a synthetic resin and configured to fit on the front end of the tower 22 of the housing main body 21. The front cap 40 has a front wall 41 and transversely adjacent partition walls 42 project from the rear surface of the front wall 41. The partition walls 42 are dimensioned and disposed for insertion between the locks 30. Thus, the partition walls 42 form parts of side walls of the respective cavities 25 at locations substantially adjacent the locks 30.

Figure 5:
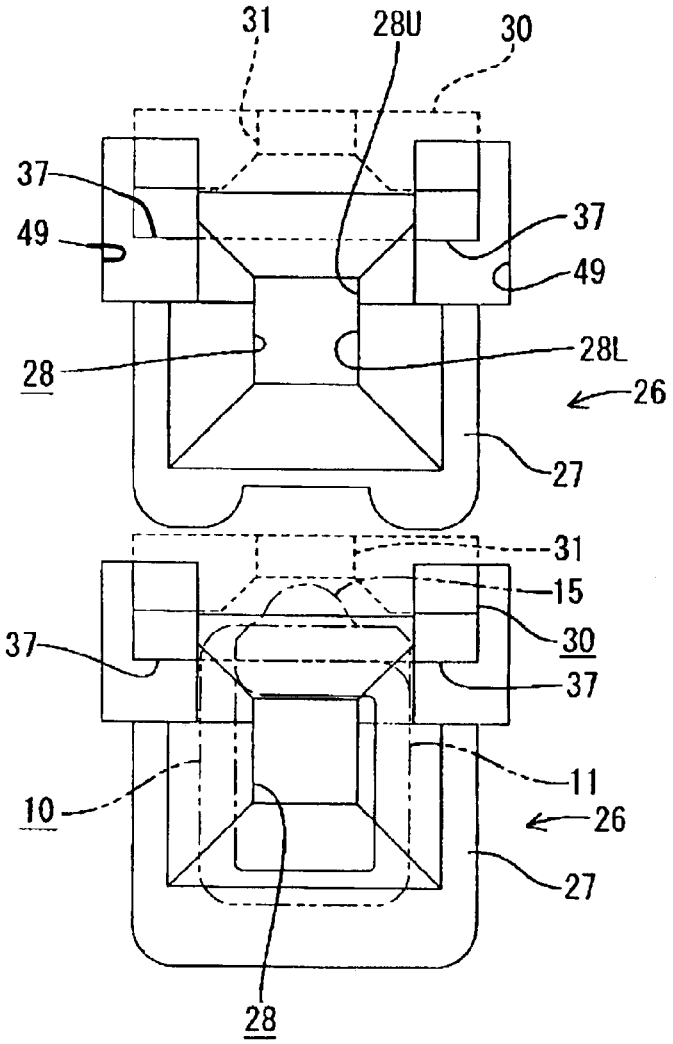
FIG. 5 is a fragmentary enlarged front view showing a portion near terminal insertion openings.

The front wall 41 is formed with upper portions 28U of the terminal insertion openings 28 at positions corresponding to the respective cavities 25, as shown in FIG. 5. Each upper portion 28U aligns with the lower portion 28L of the terminal insertion opening 28 at the front of the lower accommodating wall 27.

An upper accommodating groove 44 is formed behind the upper portion 28U of the terminal insertion opening 28 in the front wall 41 at a position between two adjacent partition walls 42. The upper accommodating groove 44 forms upper portions of the front surface and the left and right side surfaces of the front end of the cavity 25. The leading end of the connecting portion 11 of the female terminal fitting 10 is accommodated in the upper accommodating groove 44 and is dimensioned to fit closely therein along the widthwise direction. A shake preventing wall 45 is defined at the leading end of the ceiling of each upper accommodating groove 44 and cooperates with the bottom surface of the lower accommodating wall 27 to hold the connecting portion 11 tightly.

The ceiling of each upper accommodating groove 44 at the lower stage is relatively thin and is raised up slightly from a location behind the shake preventing wall 45 to a position slightly before the rear end of the partition wall 42. This slightly raised portion of the ceiling accommodates the locking section 15 of the female terminal fitting 10 and defines a retainer 46 that enters the deformation permitting space 35 for the lower stage lock 30. A rib 47 projects on the upper surface of the retainer 46 and enters the escaping groove 34 of the lower accommodating wall 27 at the upper stage so that the upper surface of the rib 47 is substantially flush with the upper end of the escaping groove 34.

The ceiling wall of the upper accommodating groove 44 at the upper stage is relatively thick and is raised up slightly from a location behind the shake preventing wall 45 to a position slightly before the rear end of the partition wall 42. The first slightly raised portion of the ceiling accommodates the locking section 15 of the female terminal fitting 10 and defines a retainer 46 that enters the deformation permitting space 35 above the upper surface of the upper stage lock 30. A step 48 behind the retainer 46 defines a portion of the deformation permitting space 35 for the upper stage lock 30.

Figure 6:
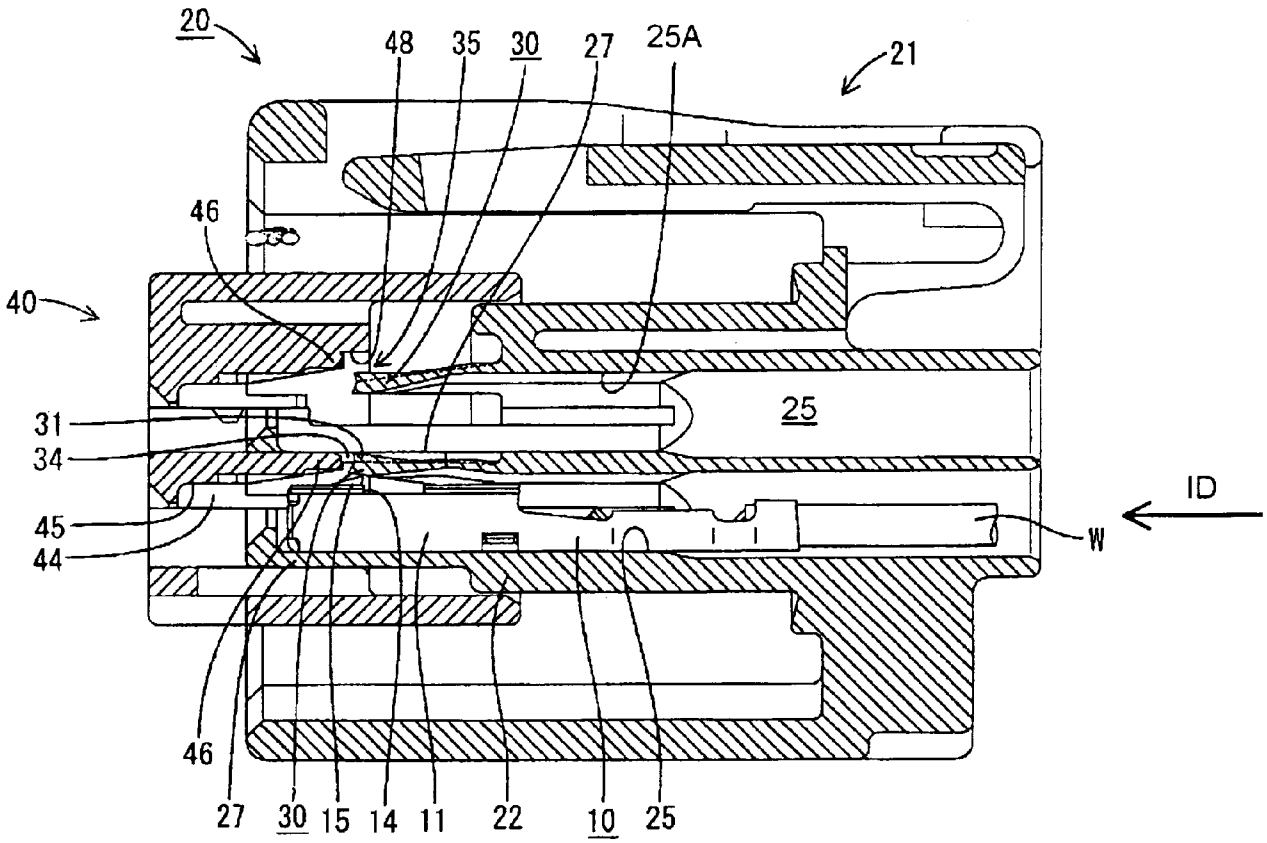
FIG. 6 is a longitudinal sectional view showing an intermediate stage of the insertion of a female terminal fitting.

The front cap 40 can be held on the front end of the tower 22 at a partial locking position shown in FIG. 6 and a full locking position shown in FIG. 8. At the partial locking position, the retainers 46 are located immediately before the deformation permitting spaces 35 for the locks 30, and hence permit the resilient deformation of the locks 30. On the other hand, at the full locking position, the front wall 41 is substantially flush with the front surface of the tower 22, and the retainers 46 are in the deformation permitting spaces 35.

Jig insertion openings 49 are formed in the surface of the front wall 41 of the front cap 40 at the left and right sides of the upper portion 28U of each terminal insertion opening 28, as shown in FIG. 5. The jig insertion openings 49 reach the bottom operable surfaces 37 at the left and right sides of the lock 30. Thus, a forked disengaging jig (not shown) can be inserted through the jig insertion openings 49 to contact the left and right operable surfaces 37 of the lock 30.

A jig insertion groove 50 is formed in the bottom of the front cap 40 and opens in the front surface, as shown in FIG. 1. Thus, the jig insertion groove 50 can be hooked at the back side by a returning jig (not shown) for returning the front cap 40 from the full locking position to the partial locking position.

The connector is assembled by mounting the front cap 40 at the partial locking position on the leading end of the tower 22, as shown in FIG. 6. Thus, the retainers 46 are retracted immediately before the corresponding deformation permitting spaces 35 for the locks 30, and the locks 30 can deform into the deformation permitting spaces 35. Further, the partition walls 42 enter areas before the locks 30 to form portions of the side walls of the cavities 25.

The female terminal fittings 10 then are inserted from behind and along the inserting direction ID into the corresponding cavities 25. More particularly, the female terminal fittings 10 are pushed into the cavities of the lower stage so that the locking section 15 of each female terminal fitting 10 contacts the bottom surface of the lock 30 at an intermediate stage, as shown in FIGS. 6 and 7. Thus, the lock 30 deforms into the deformation permitting space 35 and the elongated projection 31 escapes into the escaping groove 34 of the ceiling 25A.

The connecting portion 11 of the female terminal fitting 10 contacts the front surface of the lower accommodating wall 27 and the locking section 15 passes the leading end of the lock 30 when the female terminal fitting 10 is pushed to a proper position. Thus, the lock 30 is restored resiliently toward its original shape and fits into the locking hole 14. Additionally, the leading end surface of the lock 30, including the elongated projection 31, engages the front edge of the locking hole 14 and the locking section 15 over substantially its entire height and/or width for partly locking the female terminal fitting 10 (see FIG. 6).

Similarly, female terminal fitting 10 pushed into the upper stage cavities 25 deform the locks 30 into the deformation permitting spaces 35, including the spaces defined by the steps 48 of the front cap 40. Each lock 30 is restored toward its original shape when the female terminal fitting 10 reaches the proper position. Thus, the leading end surface of the lock 30, including the elongated projection 31, engages the front edge of the locking hole 14 and the locking section 15 over substantially its entire height and/or width, as shown in FIG. 7.

The front cap 40 is pushed to the full locking position shown in FIG. 8 when all of the female terminal fittings 10 have been inserted. Thus, the front wall 41 of the front cap 40 is substantially flush with the front surface of the tower 22, and the upper and lower portions 28U, 28L substantially align to form the terminal insertion openings 28. Further, the connecting portions 11 of the female terminal fittings 10 are held tightly between the shake preventing wall portions 45 of the upper accommodating grooves 44 and the bottom surfaces of the lower accommodating walls 27 to prevent shaking. Simultaneously, each retainer 46 projects into the corresponding deformation permitting space 35 to prevent the lock 30 from deforming into the deformation permitting space 35. As a result, the female terminal fitting 10 is locked doubly.

A female terminal fitting 10 might be left only partly inserted, as shown at the lower stage of FIG. 6. In such a case, the lock 30 still is deformed and is in the deformation permitting space 35. Thus, the leading end of the retainer 46 will strike against the leading end surface of the lock 30 to prevent the front cap 40 from being pushed to the full locking position, thereby detecting the insufficient insertion of the female terminal fitting 10. The female terminal fitting 10 then may be pushed to the proper position and the front cap 40 may be pushed to the full locking position again.

The female terminal fitting 10 can be detached from the housing 20 for maintenance by first inserting a hooked leading end of a jig into the jig insertion groove 50 of the front cap 40. The hooked leading end of the jig catches the back end surface of the groove 50. The jig then is pulled forward to return the front cap 40 to the partial locking position. Accordingly, the retainers 46 are retracted before the deformation permitting spaces 35.

Subsequently, the forked disengaging jig is inserted through the jig insertion opening 49 in the front cap 40 and slips under the operable surfaces 37 of the lock 30. The jig then is pivoted to deform the lock 30 into the deformation permitting space 35. As a result, the lock 30 disengages from the locking hole 14 and the locking section 15, and the female terminal fitting 10 can be withdrawn backward from the cavity 25 by pulling the wire W.

As described above, the elongated projection 31 reinforces the lock 30 and provides a large engaging area with the female terminal fitting 10. Thus, the locking force of the lock 30 is high. The elongated projection 31 on the lock 30 at the lower stage escapes into the escaping groove 34 in the lower accommodating wall 27 between the cavities 25 at the upper and lower stages. Therefore, the height of the housing is reduced while still keeping the necessary dimension of the deformation permitting space 35 between the lock 30 and the lower accommodating wall 27.

Opposite sides of the lock 30 contact the bottom surface of the lower accommodating wall 27 at the opposite sides of the escaping groove 34 to prevent excessive deformation of the lock 30.

The elongated projection 31 is formed substantially symmetrically on the lock 30. Thus, the lock 30 can be deformed straight and in a well-balanced manner that permits the female terminal fitting 10 to be inserted smoothly.

The partition walls 42 of the front cap 40 are formed separately and mounted afterward to define parts of the side walls of the cavities 25 where the locks 30 are provided.

Thus, the locks 30 can be formed substantially over the entire widths of the cavities 25. This also reinforces the locking forces of the locks 30. Further, the sides of the wide locks 30 project beyond the sides of the female terminal fittings 10 and define operable portions for disengagement.

The front wall member 40 has the shake preventing walls 45. Thus, the female terminal fittings 10 will not shake in the cavities 25.

The retainers 46 of the front cap 40 lock the female terminal fittings 10 doubly and detect insufficient insertion of the female terminal fitting 10.

Figure 9:
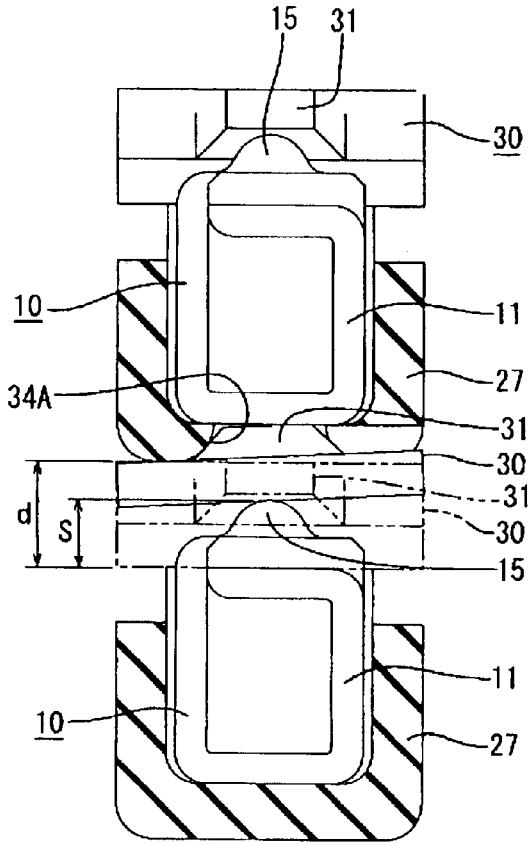
FIG. 9 is a fragmentary enlarged lateral sectional view showing a resiliently deformed state of a locking portion according to a second embodiment.
Figure 10:
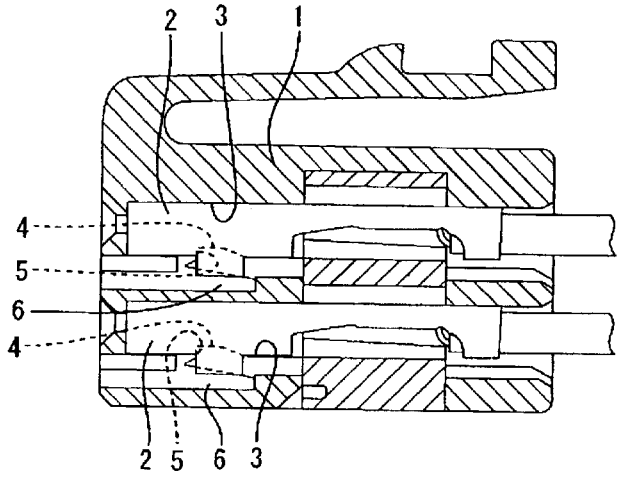
FIG. 10 PRIOR ART
FIG. 10 is a longitudinal sectional view of a prior art connector.

A second embodiment of the invention is shown in FIG. 9. This embodiment differs from the first embodiment in that an escaping groove 34A for the escape of the elongated projection 31 of the lower stage lock 30 is widened at one side. Thus, only a portion of the lower accommodating wall 27 at the left side in FIG. 9 can contact the left side of the lock 30. Thus, the lock 30 undergoes a twisting resilient deformation during the insertion of the female terminal fitting 10 and turns to upper-right side after the left side contacts the portion of the lower accommodating wall 27 at the left side of the escaping groove 34A.

In the first embodiment, opposite sides of the lock 30 contact the portions of the lower accommodating wall 27 at opposite sides of the escaping groove 34, as shown in FIG. 7. If a lifted extent S of the middle of the bottom surface of the lock 30 necessary for the passage of the female terminal fitting 10 is assumed to be constant, a distance D is necessary between a position of the lock 30 before its resilient deformation and a position of the bottom end of the escaping groove 34 in the first embodiment. Contrary to this, a smaller distance d is sufficient in the second embodiment, as shown in FIG. 9. This means that the upper stage cavity 25 can be lower than in the first embodiment. As a result, the height of the connector housing can be reduced further.

The invention is not limited to the above described and illustrated embodiments. For example, following embodiments are also embraced by the technical scope of the present invention as defined by the claims. Beside the following embodiments, various changes can be made without departing from the scope and spirit of the present invention as defined by the claims.

The insertion opening for the jig used to deform and disengage the lock may be provided only at one side corresponding to one side of the lock.

The elongated projection may be provided at any desired position of the lock along widthwise direction.

The invention is applicable to a construction where the front walls of the cavities are integral or unitary and not formed by a separate member.

The invention is applicable to male connectors with male terminal fittings.

What is claimed is:

1. A connector, comprising:

a housing with at least one cavity for receiving at least one terminal fitting; and a resiliently deformable lock being provided at a wall of the cavity and being configured for engaging the terminal fitting;

wherein a projection is formed on a surface of the lock facing the wall of the cavity, and a recess is formed in the wall for receiving the projection when the lock is deformed, the recess in the wall communicating with an adjacent cavity.

2. The connector of claim 1, the cavity has no side walls adjacent opposite widthwise sides of the lock, operable portions projecting laterally from the opposite widthwise sides of the lock in areas of the cavity that have no side walls so that the lock at locations aligned with the operable portions is wider than the cavity, the operable portions being configured to be engaged by a disengaging jig for resiliently deforming the lock.

3. The connector of claim 1, wherein the projection is located at a substantially widthwise center position of the lock.

4. The connector of claim 1, wherein the projection is formed at an area of the lock excluding one widthwise side thereof, and only one side can contact an opening edge of the recess when the lock is deformed.

5. The connector of claim 1, wherein a front cap is mounted at a front portion of the housing.

6. The connector of claim 5, wherein the front cap has a shake preventing wall to cooperate with a wall of the cavity opposite from the wall with the lock for tightly holding a terminal fitting in the cavity.

7. The connector of claim 5, wherein the front cap has a retainer projecting into a deformation permitting space for the lock for preventing deformation of the lock.

8. The connector of claim 1, wherein cavities are provided at at least two stages.

9. The connector of claim 8, wherein the projection is formed so as not to project into the adjacent cavity when the lock is deformed.

10. The connector of claim 1, wherein the lock is substantially as wide as the cavity.

11. The connector of claim 1, wherein the projection has a substantially trapezoidal cross section.

12. The connector of claim 1, wherein the projection is substantially parallel to a wall of the cavity opposite the wall with the lock when the look is unbiased.

* * * * *